United States Patent [19]

Lockwood

[11] Patent Number: 4,477,026

[45] Date of Patent: Oct. 16, 1984

[54] BUBBLER HEAD STRUCTURE

[75] Inventor: James F. Lockwood, Lenexa, Kans.

[73] Assignee: Imperial Underground Sprinkler Co., Lenexa, Kans.

[21] Appl. No.: 430,825

[22] Filed: Sep. 30, 1982

[51] Int. Cl.[3] ..... E03C 1/08

[52] U.S. Cl. ..... 239/428.5; 239/432

[58] Field of Search ..... 239/413, 416.4, 428.5, 239/432, 433, 434, 520, 541, DIG. 1

[56] References Cited

U.S. PATENT DOCUMENTS

| | | | |
|---|---|---|---|
| 1,078,588 | 11/1913 | McElwaine | 239/413 |
| 2,650,132 | 8/1953 | Reinecke | 239/542 |
| 2,941,729 | 6/1960 | Goodrie | 239/428.5 |
| 3,471,091 | 10/1969 | Baker | 239/428.5 |
| 3,502,270 | 3/1970 | Prencipe | 239/458 |
| 3,648,932 | 3/1972 | Ewald et al. | 239/428.5 |
| 3,664,589 | 5/1972 | Jatho et al. | 239/428.5 |
| 3,768,735 | 10/1973 | Ward | 239/428.5 |
| 3,874,591 | 4/1975 | Werner | 239/106 |
| 3,983,552 | 2/1976 | Rosenberg | 340/572 |
| 4,131,234 | 12/1978 | Pescetto | 239/457 |
| 4,159,805 | 7/1979 | von Lutzow | 239/457 |

FOREIGN PATENT DOCUMENTS 401664 10/1967 Australia .

*Primary Examiner*—John J. Love
*Assistant Examiner*—Jon M. Rastello
*Attorney, Agent, or Firm*—Litman, Day & McMahon

[57] ABSTRACT

A bubbler head for use on a sprinkler or irrigation system comprises a body having a water passageway and an air passageway therethrough. The water passageway extends radially outwardly from a central entrance and includes a serpentine portion. Air is drawn through the air passageway and is thoroughly mixed with the water in a mixing chamber prior to the mixture being sprinkled or discharged onto the ground in a nonerosive fashion.

8 Claims, 5 Drawing Figures

BUBBLER HEAD STRUCTURE

BACKGROUND OF THE INVENTION

1. Field of the Invention

This invention relates to irrigation devices and more particularly, to a bubbler head.

2. Description of the Prior Art

It is known that automatic sprinkling or irrigation systems are installed for watering turf and surrounding decorative vegetation such as flowers and shrubbery. Water generally is delivered to various locations by an underground piping system connected to a plurality of external sprinkling devices spaced to guarantee healthy decorative plants, trees and grass. Problems exist with such sprinkler systems including erosion of soil as a result of the irrigation and damage to delicate foliage. In order to reduce erosion from high velocity water being sprayed onto the ground various sprinkling devices have been developed. Initially, sprinkling devices were attached to the piping systems to reduce erosion caused by large quantities of high velocity water being distributed therefrom. Improved sprinkling devices were then designed which dispensed the water in a more uniform circular pattern, but the owner could not control the amount of water dispensed through each individual nozzle. Finally, nozzles were developed which contained therein a selectively adjustable throttling means. The adjustable nozzle was an improvement over prior devices but problems still existed. As growers quickly discovered, adjustable nozzles can be extremely susceptible to vandals tinkering, leading to either over watering or under watering. More importantly, a problem with substantially all sprinkling devices remains unresolved in that water dispensed therefrom tends to erode the surrounding soil and harm delicate foliage.

SUMMARY OF THE INVENTION

A bubbler head is provided for use on a sprinkler system comprising a body having a water passageway and an air passageway therethrough. The water passageway extends radially outward from a central entrance and includes a generally serpentine portion. Air is drawn through the air passageway by aspiration means and is mixed with the water in the serpentine portion of the water passageway prior to the air and water combination being sprinkled or discharged onto the ground in a nonerosive fashion.

Air is drawn through the air passageway by aspiration means which includes an adjustable deflector plate positioned between the water passageway and the air passageway. High velocity water passing through the central entrance is directed against the deflector plate with the deflection creating a vacuum downstream of the plate which causes air to be drawn through the adjacent air passageway. The air is thoroughly mixed with the water within the serpentine passageway and particularly within a mixing chamber defined by alternating baffled walls which cause the water and air combination to flow in a turbulent fashion, aerating the water. An exit passageway is provided for orienting the water laterally outwardly from the bubbler head such that it falls to the ground in an umbrella-like fashion. The aerated water is much softer when it contacts the soil, resulting in a reduction of erosion. Also, the aerated water is less damaging to delicate plant foliages which might be harmed by prior devices.

In an alternative embodiment of the present invention, the position of the plate relative to a central supply conduit is adjustable to allow a throttling of the water flow. Further, an independent throttle means is provided for the air passageway. By adjustment of one or both of the throttles a desired volume and aeration of water can be achieved.

OBJECTS OF THE INVENTION

The principal objects of the present invention are: to provide a bubbler head which minimizes erosion and which aerates irrigation water, thereby delivering the required nutrients to plants' roots; to provide such a device which gently discharges water over the ground in an umbrella like fashion; to provide such a device which entrains air in the irrigation water prior to sprinkling the water on the ground; to provide such a device which includes a water passageway and an air passageway therethrough; to provide such a device which includes a mixing chamber wherein the air and water are mixed; to provide such a device which includes an adjustable water throttling and air throttling means; to provide such a device wherein the throttling means are hidden from view and are substantially vandal proof; to provide such a device wherein the throttling means are externally adjustable; to provide such a device wherein the air and water throttling means may be adjusted independently; to provide such a device having a limited spray pattern whereby the bubbler head may be positioned in a confined area concealed from vandals; to provide such a device which does not damage delicate foliage; to provide such a device which is economical to manufacture, efficient in use, capable of a long operating life and particularly well adapted for the proposed use.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DESCRIPTION OF THE PREFERRED EMBODIMENT

As required, detailed embodiments of the present invention are disclosed herein, however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 2:
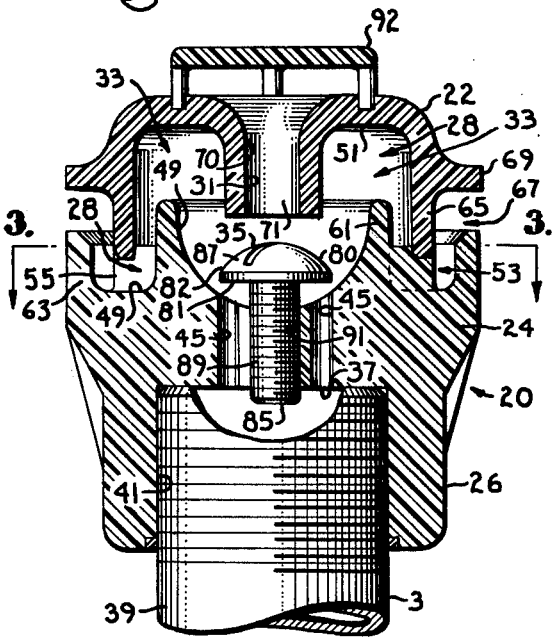
FIG. 2 is an enlarged cross-sectional side view taken along line 2—2 in FIG. 1.
Figure 3:
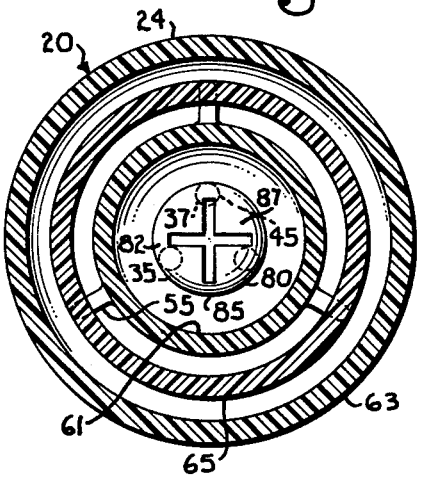
FIG. 3 is an enlarged cross-sectional plan view taken along line 3—3 in FIG. 2.

For purposes of description herein, the terms "lower", "upper", and derivatives thereof shall relate to the invention as oriented in FIG. 2. However, it is to be understood that the invention may assume various alternative orientations except where expressly specified to the contrary.

Figure 1:
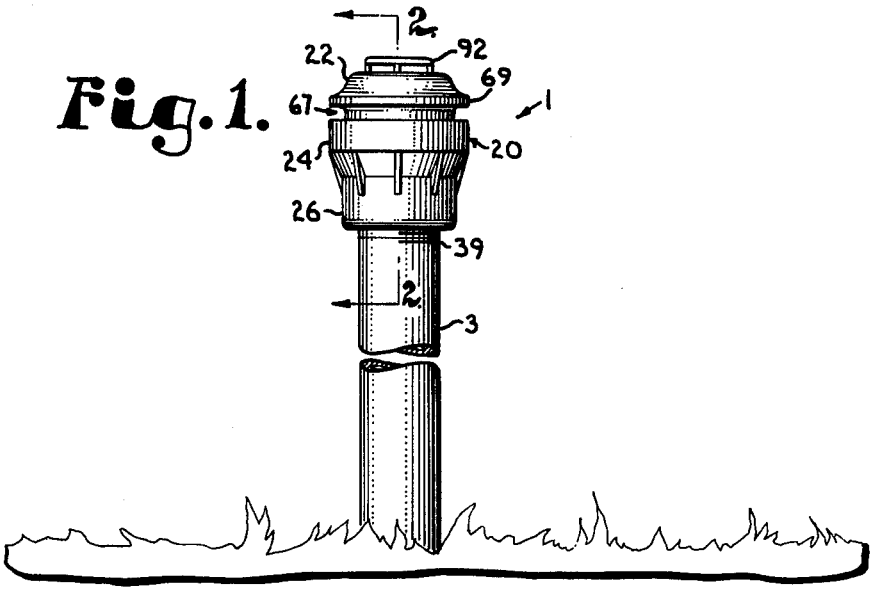
FIG. 1 is an elevational view of the bubbler head according to the present invention illustrating the bubbler head attached to a standpipe.

The reference numeral 1 generally designates the bubbler head according to the present invention. The bubbler head 1 is used to apply water for irrigation purposes in a non-erosive manner where erosion of soil is a problem. It is also anticipated that the bubbler head 1 will be used on irrigation systems associated with decorative vegetation, such vegetation being susceptible to injury if contacted by a hard spray. The bubbler head 1 is shown in FIG. 1 mounted on a standpipe 3 which is part of a suitable irrigation system. Irrigation water may be supplied for the irrigation system by a reservoir such as a river, lake or a city supply and can be pressurized by a pump or other means. Multiple other liquids could be substituted for the irrigation water described herein including nutrient enhanced water.

Normally, multiple standpipes 3 are positioned at various locations, usually in a uniformly spaced pattern. The standpipes 3 preferably are of sufficient height to facilitate watering.

The bubbler head 1 has a spray pattern approximately one foot in diameter. Each individual head 1 will irrigate a much larger area and such heads are preferably spaced approximately six feet apart. The bubbler head 1 entrains air therein, such that the water contacts the ground in a less erosive fashion. Air entrained and dissolved in the irrigation water is delivered to the soil and a portion thereof is retained by the soil. Plants which require substantial amounts of nitrogen to complete their growing process may absorb nitrogen so delivered and thereby enhance their natural growing process. Also, other gasses which are beneficial to the soil are delivered to the soil in this fashion and absorbed thereby.

The bubbler head 1 comprises a body 20 having an upper portion 22, a lower portion 24 and a supply connection means 26. The bubbler head 1 further includes a water passageway 28 and an air passageway 31 or inlet therethrough. The water passageway 28 extends radially outwardly from a central portion of the body 20 and includes a mixing chamber 33. Air is drawn through the air passageway 31 by aspiration means 35 and is mixed with the water as it flows through the mixing chamber 33 prior to being sprinkled or discharged upon the ground. The body 20 is shaped for uniform distribution of water therefrom and is preferably symmetrical about a longitudinal axis thereof.

As shown herein, the standpipe 3 is connected to a water supply source which is in water flow communication with a central entrance 37 to the water passageway 28. As shown herein, the standpipe 3 includes a threaded end portion 39 which is received by the supply connection means 26, preferably a threaded bore 41 in the body 20. The water passageway entrance 37 comprises a plurality of orifices 45 in the lower portion 24 of the body 20, with orifices 45 in flow communication with the standpipe 3, the function of which will be explained later.

The body lower portion 24 and upper portion 22 have inner surfaces 49 and 51 respectively bounding the water passageway 28. The body lower and upper portions 24 and 22, are retained in spaced apart relationship by suitable spacers 55.

The water passageway 28 has a serpentine portion 53 defined by a plurality of concentric overlapping baffle walls. Specifically, the baffle walls comprise an inner baffle wall 61, an outer baffle wall 63 and an intermediate baffle wall 65. The inner and outer baffle walls 61 and 63 extend upwardly from the body lower portion inner surface 49 whereas the intermediate baffle wall 65 extends downwardly and concentrically between the walls 61 and 63 from the upper portion inner surface 51.

An exit passageway 67 is formed in the body 20 and dispenses the mixed air and water in a nonerosive fashion. The exit passageway 67 minimizes exit velocity and uniformly distribute the water over a discharge area thereby reducing erosion. The exit passageway 67 disclosed herein, comprises a gap formed by the outer baffle wall 63 and a lip 69 extending outwardly from the intermediate baffle wall 65. Water exiting therethrough is uniformly distributed about the bubbler head 1 in an umbrella like fashion.

The aspiration means 35 draws ambient air through the air passageway 31 which thereafter is urged to be entrained with the water flowing through the bubbler head 1. The air passageway 31 is defined by and bounded by a bore 70 through a centrally located nipple 71 attached to the upper portion inner surface 51. The aspiration means 35 includes a deflector plate 80 which is positioned between the air and water passageways 31 and 28. The deflector plate 80 includes first and second sides, 81 and 82 respectively and is positioned in the line of flow of water emitting from orifices 45, which flow engages the deflector first side 81. The air passageway 31 is positioned opposed to the deflector plate second side 82. The orifices 45 preferably are axially parallel to the longitudinal axis of the body 20, the axial velocity of the irrigation water being markedly increased as it passes through the orifices 45. The deflector plate 80 directs the water laterally toward and over the inner baffle wall 61, the high velocity deflected water exerting viscous forces on the ambient air existant adjacent the deflector plate second surface 82. The ambient air is therefore continuously drawn along with the deflected water and through the water passageway 28 where it decelerates in the serpentine portion 53 thereof.

It is seen that the aspiraton means therefore comprises a combination of the deflector plate 80, the inner baffle wall 61, and the nipple 71 along with the confrontational positioning of the air passageway 31 and the water passageway 28.

Specifically as shown herein, the deflector plate 80 comprises a throttling screw 85 having a screw head 87 thereon of sufficient diameter to extend radially such as to overlap the orifices 45. The deflector plate 80 further includes a threaded shank portion 89 adapted for threadably engaging an aperture 91 in the body lower portion 24. The throttling screw 85 is selectively adjustable by inserting a suitably formed screw driver through the air passageway 31. The throttling screw 85 throttles both the air and the water flowing therethrough. The throttling screw 85 has a suitable head 87 for sealably engaging the air passageway 31 and for sealably engaging the orifices 45. The throttling screw 85 has a first position wherein the shank 89 sufficiently extends from the aperture 91 such that the screw head second side 82 sealably engages the air passageway 31; a second position comprises the screw head first side 81 sealably engaging the orifices 45 with the shank portion 89 substantially extended into the aperture 91. The throttling screw 85 may be positioned in various positions therebetween.

When air is drawn through the air passageway 31, dirt or other matter may become lodged in the air passageway 31 hindering the performance of the bubbler head 1. The bubbler head 1 may be back flushed by covering the exit passageway 67 and forcing water to exit via the air passageway 31 thereby dislodging any clogging material. A shield 92 is provided for covering the air passageway 31 and for preventing objects from being lodged therein.

As stated, air drawn through the air passageway 31 is drawn into entraining confrontation with the deflected water. Initially, the air entrained or aerated water engages the inner baffle wall 61 and turns upwardly between the nipple 71 and the inner wall 61. The air entrained water then encounters the upper portion inner surface 51 and flows downwardly parallel to the intermediate wall 65. The aerated water then engages the lower portion inner surface 49 and is forced to flow under the intermediate wall 65 and upwardly parallel to the outer baffle wall 63. Finally, the air impregnated water is urged over the top of the outer baffle wall 63 and below the lip 69 thereby resulting in the now aerated water sprinkling gently over the ground in a nonerosive fashion. In summary, the irrigation water flows from the standpipe 3 through the threaded bore 41, increases velocity through the orifices 45, deflects around the throttling screw 85, draws air through the air passageway 31 into entraining confrontation with the water, sprays over the inner baffle wall 61 flows under the intermediate baffle wall 65 and exits between the lip 69 and outer baffle wall 63 onto the ground in an umbrella like fashion. The irrigation water so distributed gently falls to the ground, substantially eliminating erosion of soil and foliage while delivering nitrogen and other gasses to the growing medium.

In operation, adjustments of the throttling screw 85 simultaneously affect both the amount of air and water allowed to flow through the respective passageways 31 and 28. For example, if the throttling screw 85 is rotated such that the head 87 nears the orifices 45 the screw 85 will restrict flow through the water passageway 28; simultaneously, flow through the air passageway 31 would be made easier. Rotation in the opposite direction results in the head 87 nearing the nipple 71 and therefore having the reverse effect of restricting flow through the air passageway 31 and making flow through the orifices 45 easier.

Figure 4:
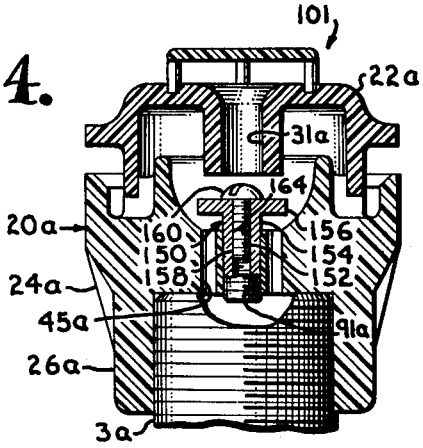
FIG. 4 is a cross-sectional side view of an alternative embodiment of the bubbler head.
Figure 5:
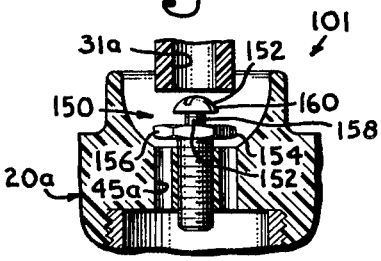
FIG. 5 is a fragmentary cross-sectional side view of the alternative embodiment.

In FIGS. 4 and 5 an alternate embodiment of the bubbler head 1 is shown and is generally designated by the reference numeral 101. Many of items in bubbler head 101 are the same as those in bubbler head 1 and will be designated by the same reference numeral with the addition of a suffix "a". Items which are particular only to bubbler head 101 will be designated by the reference numerals as they are given.

The bubbler head 101 includes aspiration means 150 to selectively and independently throttle both the air drawn through the air passageway 31*a* and water urged through the orifices 45*a*. As shown herein, the aspiration means 150 includes a throttling screw 152 and a throttling bolt 154. The throttling bolt 154 comprises a water throttling bolt and is received in the threaded aperture 91*a*. The water throttling bolt 154 further includes a head portion 156 which extends radially past the orifices 45*a*.

The throttling screw 152 comprises an air throttling screw which includes a threaded shank portion 158 and a head portion 160. As seen in FIG. 5, the shank portion 158 is threadably received within a threaded shaft 164 extending into the water throttling bolt 154. The air throttling screw head 160 is of sufficient size and shape to occlude the air passageway 31*a* when suitably adjusted.

The bubbler head 101 allows selective adjustment of both the amount of water being discharged by the bubbler head 101 and the amount of air being entrained therein.

It is to be understood that while certain forms of the present invention have been illustrated and described herein, it is not to be limited to the specific forms or arrangement of parts described and shown.

What is claimed and desired to secure by Letters Patent is as follows:

1. A bubbler head for use in impregnating irrigation water with air and gently sprinkling the impregnated water over the ground in a nonerosive fashion; said irrigation water being pressurized and supplied to the bubbler head through a standpipe; the bubbler head comprising:

(a) a body having a longitudinal axis therethrough; said body comprising:
  (1) a cylindrical lower portion having an inner and an outer surface;
  (2) a cylindrical upper portion having an inner and an outer surface;
  (3) a plurality of spacers attaching said upper portion to said lower portion;
  (4) supply connection means positioned on an inner surface of said lower portion and threadably engaging the standpipe; said connection means comprising an internally threaded coupling;
  (5) a plurality of cylindrical overlapping baffle walls comprising:
    (i) concentric inner and outer baffle walls extending upwardly from said lower portion inner surface; and
    (ii) an intermediate baffle wall concentrically extending between said inner and outer walls and attached to said upper portion inner surface;
  (6) a cylindrical nipple extending from said upper portion inner surface;
  (7) a circular lip extending outwardly from the intermediate baffle wall; and
  (8) a shield extending from the outer surface of the upper portion and positioned substantially over the nipple to prevent foreign objects from becoming lodged therein;

(b) a water passageway comprising:
  (1) an entrance to said water passageway comprising a plurality of centrally located and uniformly spaced orifices through said lower portion allowing high velocity water flow axially therethrough; said orifices being parallel to said longitudinal axis and positioned inwardly of said inner baffle wall; and
  (2) a mixing chamber including a serpentine water passageway between said baffle walls;

(c) a cylindrical air passageway comprising a bore through said upper portion and through said nipple, said air passageway communicating with said mixing chamber whereby travel of water through said mixing chamber impregnates said water with air;

(d) a cylindrical aperture concentric with said longitudinal axis extending through said lower portion;

(e) aspiration means for drawing air through the air passageway comprising a selectively adjustable throttling screw threadably engaging said aperture and having a head thereon with a first surface for deflecting high velocity water exiting said orifices; said head adapted for being contained within said inner baffle wall and of sufficient diameter for said first surface to extend completely over said orifices to deflect water exiting said orifices; said throttling screw head having a second surface positioned in facing relation to the air passageway whereby air adjacent said second surface is drawn along with the high velocity deflected water; and (f) an exit passageway between said lip and said outer baffle wall for discharging the water and air combination in a nonerosive fashion;

(g) whereby the pressurized water flows through the connection means, increases velocity through said orifices, deflects around said throttling screw, draws air through said nipple and into entrainment, flows over said inner wall, flows under said intermediate wall, flows out said exit passageway and sprinkles over the ground in an umbrella like fashion.

2. A bubbler head for an irrigation system for the application of water to soil and plants in a non-erosive and nondestructive manner, said head for connection to a water supply conduit of said irrigation system and comprising:

(a) a first body portion having a cylindrical axis, a connection end for connection of said first body portion to a pressurized water supply conduit of an irrigation system, and an opposite outlet end;

(b) said first body portion having an inner cylindrical baffle wall at said outlet end which is coaxial with said axis and which defines a mixing chamber within said inner baffle wall;

(c) a water passageway through said first body portion for the flow of water from the supply conduit to said mixing chamber;

(d) a second body portion having a cylindrical axis, centrally positioned means forming an air passageway, and an intermediate cylindrical baffle wall coaxially outward of said means forming said air passageway;

(e) spacer means connecting said second body portion coaxially to said first body portion to define a circumferential outlet passage between said first and second body portions, to position said intermediate baffle wall coaxially outwardly of said inner baffle wall, and to position said means forming said air passageway coaxially within said inner baffle wall to define a serpentine passage between said mixing chamber and said outlet; and (f) deflector means positioned in said mixing chamber in alignment with said water passageway for engagement by water issuing from said water passageway and in alignment with said air passageway whereby water from said water passageway is deflected into said mixing chamber and through said serpentine passage to said outlet, said water flowing through said mixing chamber drawing air through said air passageway and into entrainment therewith, and the flow of the mixture of water and air through said serpentine passage decreasing the velocity of the mixture whereby said mixture exits from said outlet in a non-erosive and nondestructive manner.

3. A bubbler head as set forth in claim 2 wherein:

(a) said first body portion includes a cylindrical outer baffle wall positioned coaxially outwardly of said intermediate baffle wall of said second body portion, said outer baffle wall extending said serpentine passage.

4. A bubbler head as set forth in claim 3 wherein:

(a) said second body portion includes an external circumferential lip positioned in spaced relation to said outer baffle wall to further extend said serpentine passage and to define said outlet between said lip and said outer baffle wall.

5. A bubbler head as set forth in claim 2 wherein:

(a) said deflector means is adjustable in position between said water passageway and said air passageway to control the volume of water flowing through said bubbler head.

6. A bubbler head as set forth in claim 5 wherein:

(a) said water passageway includes a plurality of water passages which are radially positioned and circumferentially spaced with respect to said axis of said first body portion; and (b) said deflector means includes a deflector screw threadably received in said first body portion and having a screw head which overlaps said water passages in radial direction, said deflector screw being adjusted to vary the position of said screw head between said water passages and said air passageway by rotation of said deflector screw.

7. A bubbler head as set forth in claim 2 wherein said deflector means includes:

(a) a water deflector positioned in alignment with said water passageway, said water deflector being adjustable to vary the spacing between said water deflector and said water passageway to control the flow of water into said mixing chamber; and (b) an air deflector positioned in alignment with said air passageway, said air deflector being adjustable to vary the spacing between said air deflector and said air passageway to control the flow of air into said mixing chamber.

8. A bubbler head as set forth in claim 7 wherein:

(a) said water passageway includes a plurality of water passages which are radially positioned and circumferentially spaced with respect to said axis of said first body portion;

(b) said water deflector includes a bolt threadably received in said first body portion, said bolt having a bolt head which radially overlaps said water passages, and said bolt being rotatable to adjust the spacing between said bolt head and said water passages to control the flow of water into said mixing chamber; and (c) said air deflector including an air deflector screw threadably received in said bolt, said air screw having an air screw head positioned in alignment with said air passageway, and said air screw being rotatable to adjust the spacing between said air screw head and said air passageway to control the flow of air into said mixing chamber.

* * * * *